US010060311B2

(12) United States Patent
Hwang et al.

(10) Patent No.: US 10,060,311 B2
(45) Date of Patent: Aug. 28, 2018

(54) ELECTRIC VALVE

(71) Applicants: Hyundai Motor Company, Seoul (KR); Kia Motors Corporation, Seoul (KR); Sejong Industrial Co., Ltd., Ulsan-si (KR)

(72) Inventors: Daegil Hwang, Suwon-si (KR); Jae Hun Shim, Hwaseong-si (KR); Jong Hwa Kang, Ulsan (KR)

(73) Assignees: Hyundai Motor Company, Seoul (KR); Kia Motors Corporation, Seoul (KR); Sejong Industrial Co., Ltd., Ulsan-si (KR)

( * ) Notice: Subject to any disclaimer, the term of this patent is extended or adjusted under 35 U.S.C. 154(b) by 90 days.

(21) Appl. No.: 15/373,813

(22) Filed: Dec. 9, 2016

(65) Prior Publication Data

US 2018/0051611 A1 Feb. 22, 2018

(30) Foreign Application Priority Data

Aug. 17, 2016 (KR) ..... 10-2016-0104545

(51) Int. Cl.
*F01N 1/18* (2006.01)
*F01N 1/16* (2006.01)

(52) U.S. Cl.
CPC ..... *F01N 1/18* (2013.01); *F01N 2260/20* (2013.01); *F01N 2390/02* (2013.01)

(58) Field of Classification Search
CPC . F01N 1/18; F01N 1/163; F01N 1/165; F01N 2390/02
USPC ..... 181/254
See application file for complete search history.

(56) References Cited

U.S. PATENT DOCUMENTS

2008/0023264 A1* 1/2008 Pacini ..... F01N 1/165 181/237
2013/0056083 A1* 3/2013 Abram ..... F01N 1/08 137/2
2017/0089270 A1* 3/2017 Oblinger ..... F02D 9/1045

FOREIGN PATENT DOCUMENTS

DE 102010047464 A1 * 4/2012 ..... F01N 13/1811
JP 2005083358 A * 3/2005 ..... F01N 13/10
KR 10-1436039 B1 9/2014
KR 10-1568338 B1 11/2015
KR 10-1624242 B1 5/2016

* cited by examiner

*Primary Examiner* — Jeremy Luks
(74) *Attorney, Agent, or Firm* — Morgan, Lewis & Bockius LLP

(57) ABSTRACT

An electric valve may include a valve housing, a valve plate disposed in the exhaust gas passage of the valve housing by a rotation shaft, a heat shield being connected to the valve housing by a bracket and forming a penetration opening to be penetrated by an upper end portion of the rotation shaft, an actuator assembled on the heat shield to decelerate torque of a drive actuator and then to output the decelerated torque, a power delivering member transferring torque of the drive actuator, wherein damping is performed by a power delivering spring disposed between a spring seat mounted the rotation shaft and the worm wheel of the actuator, to the rotation shaft, and a rotation limiting member mounted between the penetration opening of the heat shield and the spring seat corresponding with the penetration opening to limit a rotation angle of the rotation shaft.

10 Claims, 6 Drawing Sheets

ELECTRIC VALVE

CROSS-REFERENCE TO RELATED APPLICATION

The present application claims priority to Korean Patent Application No. 10-2016-0104545 filed on Aug. 17, 2016, the entire contents of which is incorporated herein for all purposes by this reference.

BACKGROUND OF THE INVENTION

Field of the Invention

The present invention relates to an electric valve, more particularly, to an electric valve for preventing that a pivot shaft of a valve plate opening or closing an exhaust gas passage is closed by ice.

Description of Related Art

Generally, a muffler for a vehicle is a device for lowering a pressure and a temperature of exhaust gas before exhausting exhaust gas having a high temperature and a high pressure, which is exhausted from an engine, into atmosphere outside a vehicle, thereby reducing explosion noise generated by drastic expansion of exhaust gas.

According to the muffler, exhaust noise may be reduced, however, a back pressure, that is, resistance occurred during an exhaust stroke may be increased if resistance of the muffler is to be strong for improving effect of decreasing noise, and thus output power of an engine may be deteriorated. On the other hands, there is a problem that exhaust noise is increased if resistance of the muffler is to be weak for lowering a back pressure.

For solving the above mentioned problem, an electric valve appropriately controlling exhaust noise and a back pressure depending on a driving condition may be mounted to an outlet of the muffler.

But, the conventional electric valve may have high possibility to be closed by ice, thereby malfunctioning, as moisture contained exhaust gas is flowed into the electric valve and then is frozen therein during the cold weather.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an electric valve having advantages of preventing malfunction by freezing.

The electric valve according to an exemplary embodiment of the present invention may be an electric valve which is mounted between an outlet pipe and a tail pipe at a muffler for a vehicle to switch a passage of exhaust gas by a valve plate being automatically controlled depending on a vehicle speed and opening a throttle valve. The electric valve may include a valve housing configured so that the outlet pipe and tail pipe of the muffler are respectively connected to both end portions thereof and an exhaust gas passage is formed therein, a valve plate disposed in the exhaust gas passage of the valve housing by a rotation shaft to open or close the exhaust gas passage, a heat shield being connected to the valve housing by a bracket and forming a penetration hole to be penetrated by an upper end portion of the rotation shaft penetrates thereto, an actuator assembled on the heat shield to decelerate torque of a drive motor by using a worm and a worm wheel and then to output the decelerated torque, a power delivering member transferring torque of the drive motor, that damping is performed by a power delivering spring disposed between a spring seat mounted on the upper end portion of the rotation shaft and the worm wheel of the actuator, to the rotation shaft, and a rotation limiting member provided between the penetration hole of the heat shield and one side of a circumference of the spring seat corresponding with the penetration hole to limit a rotation angle of the rotation shaft.

The power delivering member may include a spring seat mounted to be fixed to the upper end portion of the rotation shaft, and a power delivering spring formed to be coiled with a spiral shape so that both end portions thereof are respectively fixed to the spring seat and the worm wheel.

A rim portion may be formed to be upwardly protruded along a circumference thereof of an upper surface of the spring seat, and Seated grooves, which are symmetric with respect to a center, may be formed at the rim portion such that a lower end portion of the power delivering spring is wedged therein.

A seating flange may be formed at the upper end portion of the rotation shaft, and a center pin may be formed at a center of the seating flange, and a center portion of the spring seat may be wedged to the center pin such that the spring seat is fixed to the seating flange.

The rotation limiting member may include a stopper formed at one side of the penetration hole of the heat shield to be protruded toward the inside, and a supporting end portion formed to be downwardly protruded at one side of a lower end portion of the spring seat to be supported to the stopper depending on the rotation thereof.

According to an exemplary embodiment of the present invention, causes including moisture and foreign materials to occur the malfunction can be removed by deleting an ordinary stopper structure which has been applied to be formed at a lower end portion of a rotation shaft and applying a stopper structure including the stopper and the supporting end portion between the heat shield corresponding with an upper portion of the rotation shaft and the spring seat.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
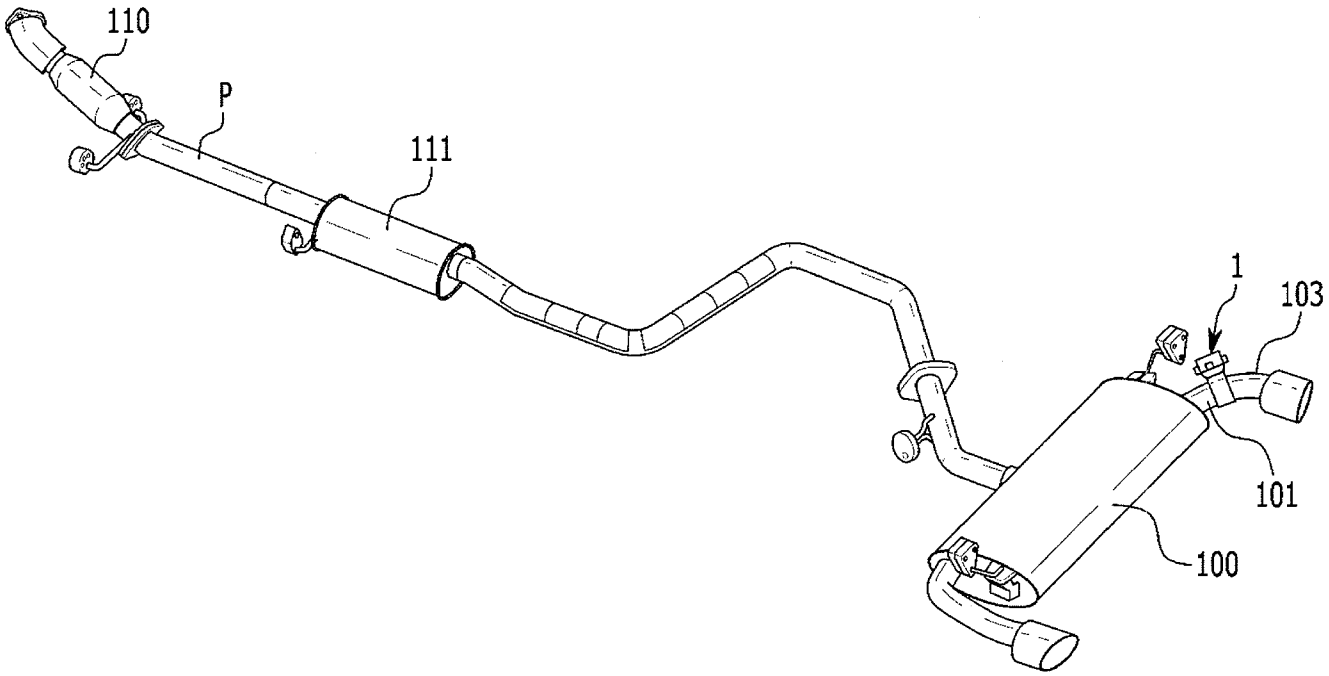
FIG. 1 is a drawing illustrating a portion of an exhaust system applying an electric valve according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 2:
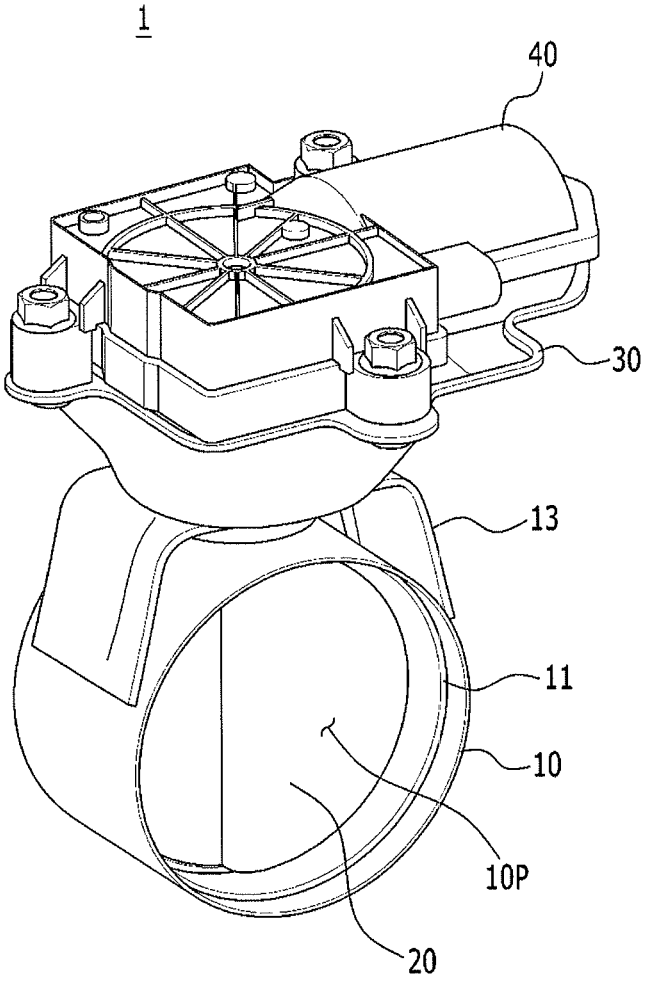
FIG. 2 is a perspective view of an electric valve according to an exemplary embodiment of the present invention.
Figure 3:
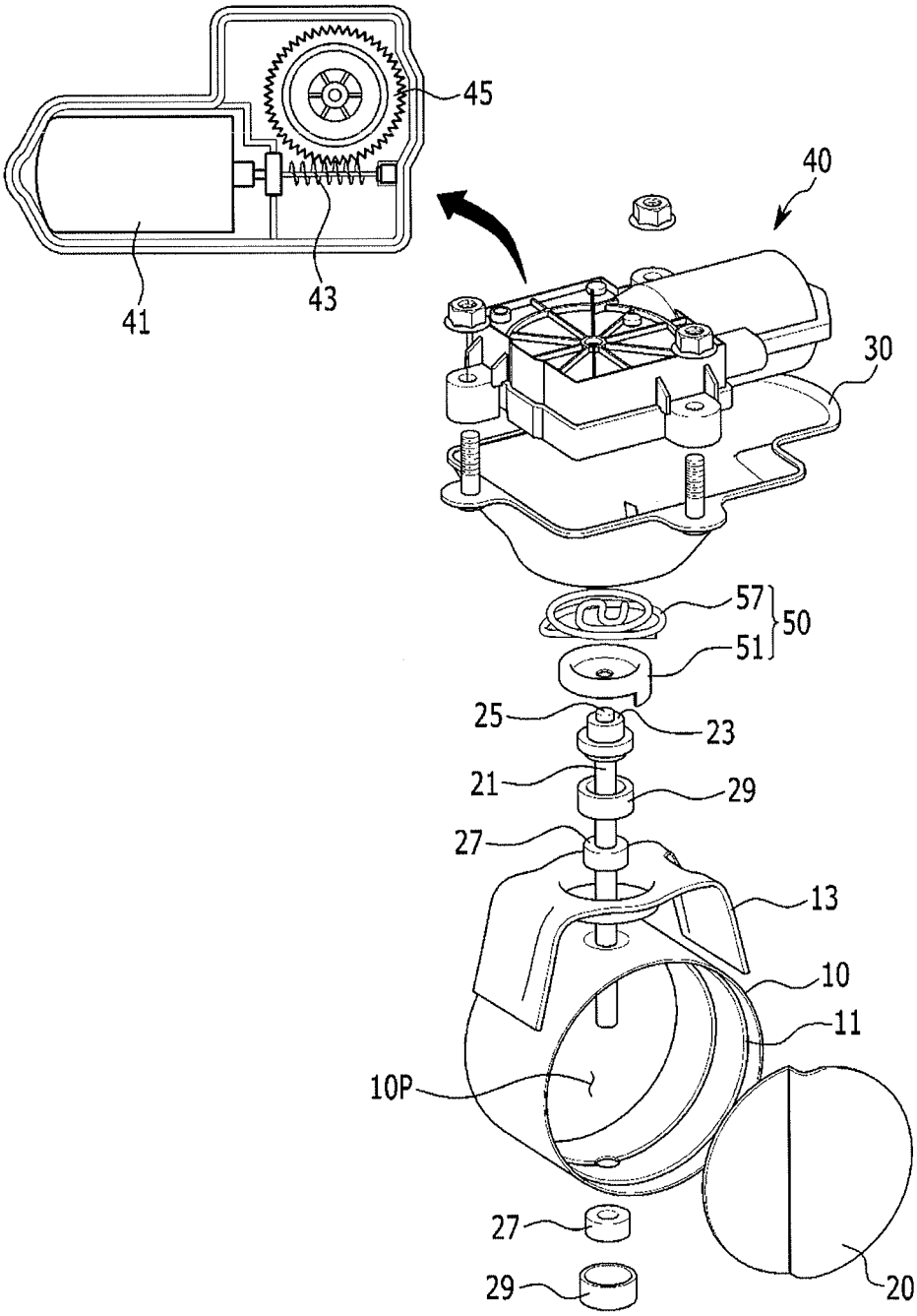
FIG. 3 is an exploded perspective view of an electric valve according to an exemplary embodiment of the present invention.

FIG. 1 is a drawing illustrating a portion of an exhaust system applying an electric valve according to an exemplary embodiment of the present invention, FIG. 2 is a perspective view of an electric valve according to an exemplary embodiment of the present invention, and FIG. 3 is an exploded perspective view of an electric valve according to an exemplary embodiment of the present invention.

Referring to FIG. 1, an electric valve 1 according to an exemplary embodiment of the present invention is provided to an exhaust system which is mounted on a vehicle body.

In this regard, the exhaust system has a structure that a catalytic converter 110, a sub muffler 111, and a main muffler 100 are communicated with an exhaust pipe P extended from an exhaust manifold of an engine.

That is, the exhaust system acts to reduce noise as exhaust noise is repeatedly absorbed by being passed through the catalytic converter 110, the sub muffler 111, and the main muffler 100.

The electric valve 1 according to an exemplary embodiment of the present invention is mounted to be close with the main muffler 100 of the exhaust system for switching a passage of exhaust gas.

In other word, the electric valve 1 is mounted between an outlet pipe 101 and a tail pipe 103 which are connected with the main muffler 100 for a vehicle.

The electric valve 1 switches the passage of exhaust gas by operation of a valve plate 20 being automatically controlled depending on opening a throttle valve and a vehicle speed.

Referring to FIG. 2 and FIG. 3, the electric valve 1 includes a valve housing 10, a valve plate 20, a heat shield 30, an actuator 40, a power delivering member 50, and a rotation limiting member 60.

Firstly, the valve housing 10 is formed in a cylindrical pipe shape so that the outlet pipe 101 and tail pipe 103 of the main muffler 100 are respectively connected with both end portions thereof.

In this regard, a stepped surface 11 is formed at respective both sides of an inside circumference of the valve housing 10 such that the outlet pipe 101 and tail pipe 103 of the main muffler 100 are respectively supported by the stepped surface 11.

An exhaust gas passage 10*p* is formed inside the valve housing 10.

In addition, the valve plate 20 is mounted in the valve housing 10.

That is, the valve plate 20 is mounted in the exhaust gas passage 10*p* of the valve housing 10 by a rotation shaft 21, opening or closing the exhaust gas passage 10*p*.

The rotation shaft 21 is configured so that a seating flange 23 is formed at an upper end portion thereof.

In addition, the rotation shaft 21 is configured so that a center pin 25 is formed at a center of the seating flange 23.

A bearing 27 and a bearing cap 29 for minimizing a frictional force are disposed at a portion which connects the rotation shaft 21 with the valve housing 10.

That is, the rotation shaft 21 is disposed to penetrate the valve housing 10 to be supported by the bearing 27 and the bearing cap 29 which are arranged along an up and down direction of a valve housing 10.

The heat shield 30 is connected with the valve housing 10 through the bracket 13, and a penetration hole 31 is formed at the heat shield 30 such that the heat shield 30 is penetrated by an upper end portion of the rotation shaft 21.

The heat shield 30 is configured to prevent that heat being generated from exhaust gas having a high temperature passing through the exhaust gas passage 10*p* of the valve housing 10 is transferred toward the actuator 40 which is positioned thereover.

The actuator 40 is assembled on the heat shield 30 by a bolt.

The actuator 40 includes a drive motor 41, a worm 43, and a worm wheel 45.

That is, the actuator 40 is configured so that the worm 43 is mounted on a drive shaft of the drive motor 41 and the worm wheel 45 being engaged to gear teeth of the worm 43 is rotated by driving torque of the drive motor 41.

The actuator 40 receives a signal about opening or closing the exhaust gas passage 10*p* from an electronic control unit (ECU, not shown) for a vehicle, rotating the valve plate 20.

The power delivering member 50 includes a spring seat 51 and a power delivering spring 57.

Figure 4A:
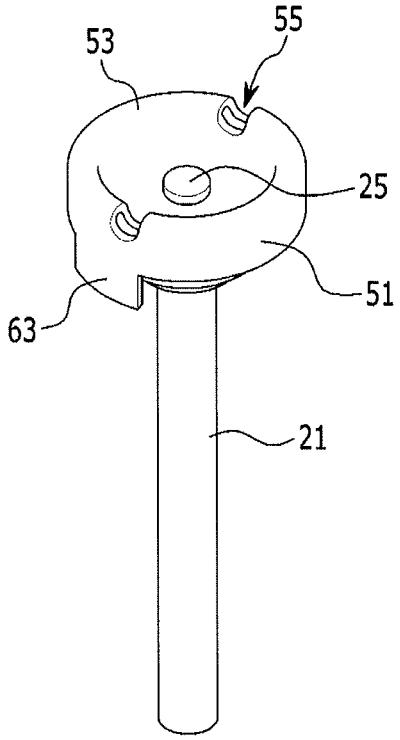
FIG. 4A and FIG. 4B are perspective views of a rotation limiting member being applied to an electric valve according to an exemplary embodiment of the present invention.

Referring to FIG. 4A, the spring seat 51 is fixed to the seating flange 23 as a center portion thereof is inserted into the center pin 25 the rotation shaft 21.

The spring seat 51 is configured such that a rim portion 53 is formed to be upwardly protruded along a circumference thereof of an upper surface thereof.

Seated grooves 55, which are symmetric with respect to a center, are formed at the rim portion 53 such that a lower end portion of the power delivering spring 57 is wedged therein.

Figure 4B:
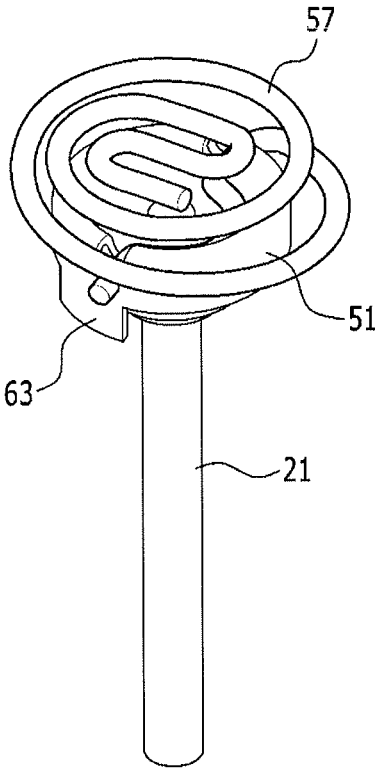

Referring to FIG. 4B, the power delivering spring 57 is formed to be coiled with a spiral shape so that both end portions thereof are respectively fixed to the spring seat 51 and the worm wheel 45 of the actuator 40.

The power delivering member 50 transfers torque of the drive motor 41, that damping is performed by the power delivering spring 57, to the rotation shaft 21.

Figure 5:
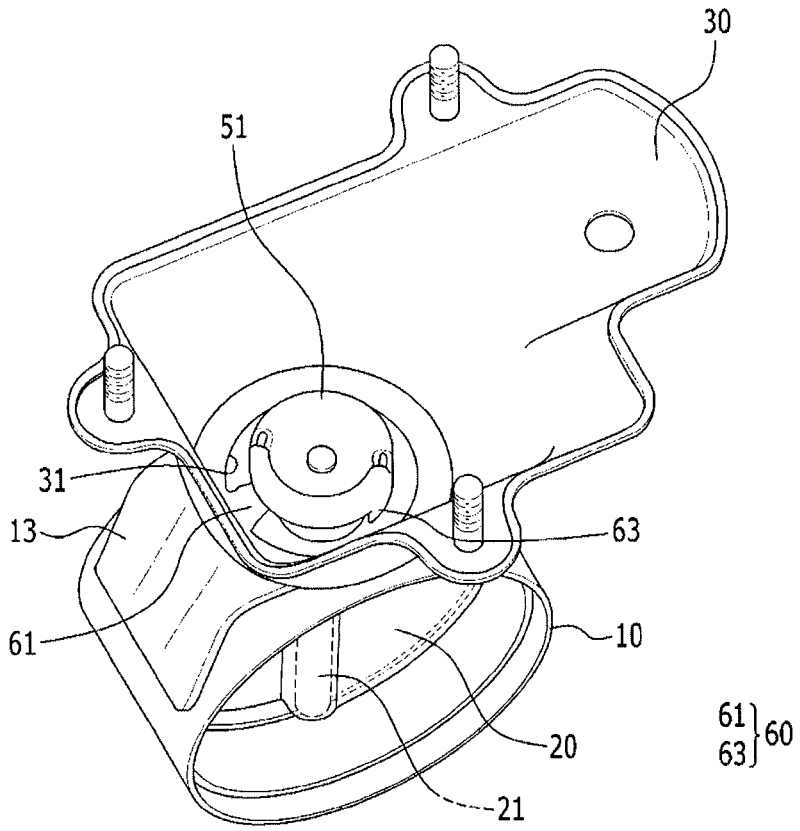
FIG. 5 is a perspective view a power delivering member being applied to an electric valve according to an exemplary embodiment of the present invention.

Referring to FIG. 5, the rotation limiting member 60 includes a stopper 61 and a supporting end portion 63.

In this regard, the stopper 61 is formed to be protruded from one side of the penetration hole 31 of the heat shield 30 toward the inside.

In addition, the supporting end portion 63 is formed to be downwardly protruded from a lower end portion of the spring seat 51 so as to be supported to the stopper 61 depending on the rotation thereof.

The rotation limiting member 60 is disposed between the penetration hole 31 of the heat shield 30 and one side of a circumference of the spring seat 51 corresponding with the penetration hole 31, limiting a rotation angle of the rotation shaft 21.

The electric valve 1 according to an exemplary embodiment of the present invention configured so that an ordinary stopper structure which has been applied to be formed at a lower end portion of a rotation shaft is removed, and the stopper 61 is provided to one side of the penetration hole 31 of the heat shield 30 corresponding with an upper portion of the rotation shaft 21, and the supporting end portion 63 is provided to one side of a circumference of the spring seat 51 corresponding with the stopper 61 such that a rotation angle of the rotation shaft 21 is limited. Therefore, causes, such as moisture and foreign materials, to occur the malfunction of the rotation shaft 21 can be removed.

As a result, operation reliability of the valve plate 20 can be improved.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "interior", "exterior", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An electric valve which is mounted between an outlet pipe and a tail pipe at a muffler for a vehicle to switch a passage of exhaust gas by a valve plate being automatically controlled depending on a vehicle speed and opening a throttle valve, comprising:

a valve housing configured so that the outlet pipe and the tail pipe of the muffler are respectively connected to first and second end portions thereof and an exhaust gas passage is formed therein;

the valve plate disposed in the exhaust gas passage of the valve housing by a rotation shaft to open or close the exhaust gas passage;

a heat shield being connected to the valve housing by a bracket and forming a penetration opening to be penetrated by an upper end portion of the rotation shaft thereto;

an actuator assembled on the heat shield to decelerate torque of a drive actuator by using a worm and a worm wheel and then to output a decelerated torque;

a power delivering member transferring torque of the drive actuator, wherein damping is performed by a power delivering spring disposed between a spring seat mounted on the upper end portion of the rotation shaft and the worm wheel of the actuator, to the rotation shaft; and a rotation limiting member mounted between the penetration opening of the heat shield and a first side of a circumference of the spring seat corresponding with the penetration opening to limit a rotation angle of the rotation shaft.

2. The electric valve of claim 1, wherein the power delivering member comprises:

the spring seat mounted to be fixed to the upper end portion of the rotation shaft; and the power delivering spring formed to be coiled with a spiral shape so that first and second end portions thereof are respectively fixed to the spring seat and the worm wheel.

3. The electric valve of claim 2, wherein a rim portion is formed to be upwardly protruded along a circumference thereof of an upper surface of the spring seat, and seated grooves, which are symmetric with respect to a center, are formed at the rim portion, wherein a lower end portion of the power delivering spring is wedged therein.

4. The electric valve of claim 1, wherein a seating flange is formed at the upper end portion of the rotation shaft, and a center pin is formed at a center of the seating flange, and a center portion of the spring seat is wedged to the center pin, wherein the spring seat is fixed to the seating flange.

5. The electric valve of claim 1, wherein the rotation limiting member includes:

a stopper formed at a first side of the penetration opening of the heat shield to be protruded toward the inside; and a supporting end portion formed to be downwardly protruded at a first side of a lower end portion of the spring seat to be supported to the stopper depending on ae rotation thereof.

6. An electric valve which is adapted, for switching a passage of exhaust gas by controlling a valve plate depending on a vehicle speed and opening a throttle valve, so that the valve plate for opening or closing an exhaust gas passage is disposed by a rotation shaft in the exhaust gas passage of a valve housing, which is configured so that an outlet pipe and a tail pipe of a muffler are respectively connected to first and second end portions thereof and the exhaust gas passage is formed therein, and an actuator, which is assembled to a heat shield mounted on the valve housing to decelerate torque of a drive actuator by using a worm and a worm wheel and then to output a decelerated torque, is provided thereto, and a penetration opening is formed at the heat shield, wherein an upper end portion of the rotation shaft penetrates the heat shield, including:

a power delivering member transferring torque of the drive actuator, wherein damping is performed by a power delivering spring disposed between a spring seat mounted on the upper end portion of the rotation shaft and the worm wheel of the actuator, to the rotation shaft; and a rotation limiting member mounted between the penetration opening of the heat shield and a first side of a circumference of the spring seat corresponding with the penetration opening to limit a rotation angle of the rotation shaft.

7. The electric valve of claim 6, wherein the power delivering member comprises:

the spring seat mounted to be fixed to the upper end portion of the rotation shaft; and the power delivering spring formed to be coiled with a spiral shape so that first and second end portions thereof are respectively fixed to the spring seat and the worm wheel.

8. The electric valve of claim 7, wherein a rim portion is formed to be upwardly protruded along a circumference thereof of an upper surface of the spring seat, and seated grooves, which are symmetric with respect to a center, are formed at the rim portion, wherein a lower end portion of the power delivering spring is wedged therein.

9. The electric valve of claim 6, wherein a seating flange is formed at the upper end portion of the rotation shaft, and a center pin is formed at a center of the seating flange, and a center portion of the spring seat is wedged to the center pin, wherein the spring seat is fixed to the seating flange.

10. The electric valve of claim 6, wherein the rotation limiting member includes:

a stopper formed at a first side of the penetration opening of the heat shield to be protruded toward an inside thereof; and a supporting end portion formed to be downwardly protruded at a first side of a lower end portion of the spring seat to be supported to the stopper depending on a rotation thereof.

* * * * *